US006213800B1

(12) United States Patent
Mramor

(10) Patent No.: US 6,213,800 B1
(45) Date of Patent: Apr. 10, 2001

(54) SHORTING CLIP FOR AIR BAG INFLATOR

(75) Inventor: Vincent J. Mramor, Chandler, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/343,574

(22) Filed: Jun. 30, 1999

(51) Int. Cl.[7] ..... H01R 29/00
(52) U.S. Cl. ..... 439/188
(58) Field of Search ..... 280/736, 741; 439/188, 668, 607, 610, 630, 86, 886

(56) References Cited

U.S. PATENT DOCUMENTS

| | | | | |
|---|---|---|---|---|
| 4,921,453 | | 5/1990 | O'Brien . | |
| 5,624,133 | * | 4/1997 | Wong | 280/741 |
| 5,727,956 | | 3/1998 | Mitra et al. . | |
| 5,733,135 | | 3/1998 | Kennedy et al. . | |
| 5,860,812 | | 1/1999 | Gugliotti . | |
| 6,007,096 | * | 12/1999 | Shirk et al. | 280/736 |
| 6,073,963 | * | 6/2000 | Hamilton et al. | 280/741 |

* cited by examiner

*Primary Examiner*—Neil Abrams
*Assistant Examiner*—J. F. Duverne
(74) *Attorney, Agent, or Firm*—Tarolli, Sundheim, Covell, Tummino & Szabo L.L.P.

(57) ABSTRACT

A shorting clip (100) for establishing a short circuit between first and second electrical terminals (64, 66) of an air bag inflator initiator (62) includes a body of electrically insulating material (102) having portions engageable with the initiator for connecting the shorting clip to the initiator. The body of electrically insulating material (102) has first and second contact portions (140, 142) engageable with the first and second electrical terminals (64, 66) of the initiator (62) when the shorting clip (100) is connected to the initiator. The shorting clip (100) also comprises an electrically conductive plating (152, 154) on each one of the contact portions (140, 142) for establishing electrical contact between the shorting clip and the first and second terminals (64, 66) of the initiator (62).

8 Claims, 3 Drawing Sheets

SHORTING CLIP FOR AIR BAG INFLATOR

BACKGROUND OF THE INVENTION

1. Technical Field

The present invention relates to an inflator for inflating a vehicle occupant protection device to help protect an occupant of a vehicle. In particular, the present invention relates to a shorting clip for an inflator having an electrically energizable initiator.

2. Description of the Prior Art

It is known to help protect a vehicle occupant by inflating an air bag with inflation fluid from an air bag inflator. The inflation fluid is released from a container in the inflator and/or generated by ignition of combustible gas generating material in the inflator.

The inflator may use an electrically actuatable initiator to open the container and/or to ignite the gas generating material. A typical initiator has two terminals. The terminals are in electrical contact with an electrical connector which is part of vehicle electric circuitry. To actuate the inflator, the vehicle electric circuitry sends an electric signal through the electrical connector and the terminals to the initiator. The electric signal actuates the initiator, resulting in actuation of the inflator.

It is desirable to provide an electrical short circuit between the terminals of the inflator prior to connection of an electrical connector with the terminals. The short circuit prevents inadvertent actuation of the initiator. U.S. Pat. No. 5,733,135 describes an inflator having a shorting clip that functions in this manner.

SUMMARY OF THE INVENTION

The present invention is a shorting clip for establishing a short circuit between first and second electrical terminals of an air bag inflator initiator. The shorting clip comprises a body of electrically insulating material having connector portions engageable with the initiator for connecting the shorting clip to the initiator. The body of electrically insulating material has first and second contact portions engageable with the first and second electrical terminals of the initiator when the shorting clip is connected to the initiator. The shorting clip also comprises an electrically conductive plating on each one of the contact portions for establishing electrical contact between the shorting clip and the first and second terminals of the initiator.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

The present invention relates to an inflator for inflating a vehicle occupant protection device to help protect an occupant of a vehicle. The present invention is applicable to various inflator constructions, including inflators of different shapes and sizes and inflators with different modes of operation. For example, the invention can be applied to inflators which release inflation fluid from a container and/or which generate inflation fluid by ignition of combustible gas generating material.

Figure 1:
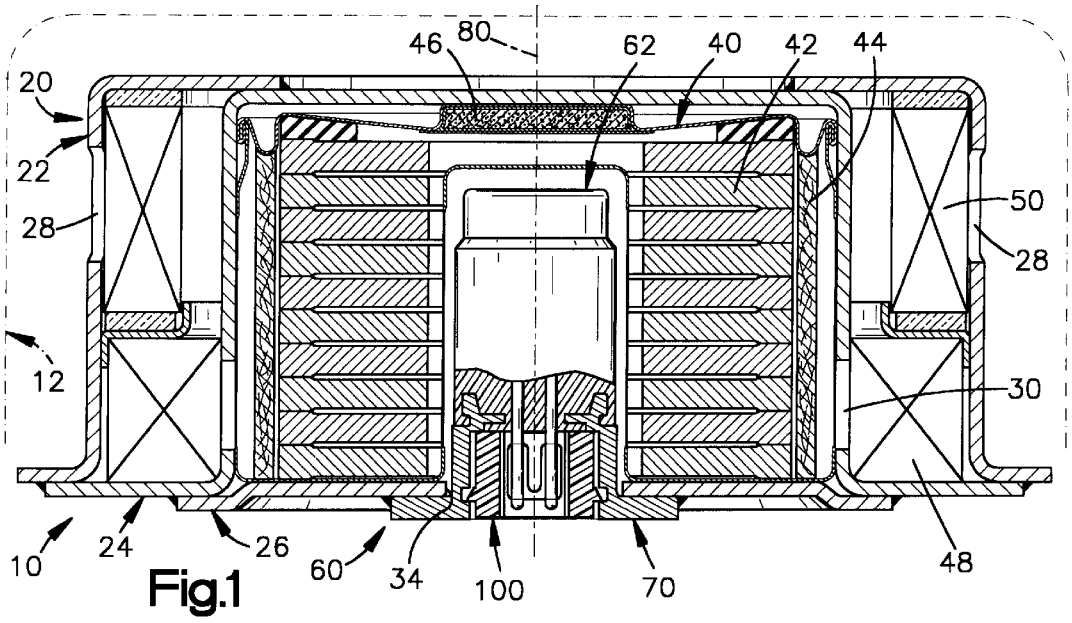
FIG. 1 is a transverse sectional view of an inflator including an initiator assembly and a shorting clip constructed in accordance with the present invention, with the shorting clip in position in the initiator assembly.

As representative of the present invention, FIG. 1 illustrates an inflator 10 for inflating an air bag indicated schematically at 12. The inflating air bag 12 moves into the space between a driver of a vehicle and a vehicle steering wheel (not shown) to help protect the driver of the vehicle.

Figure 2:
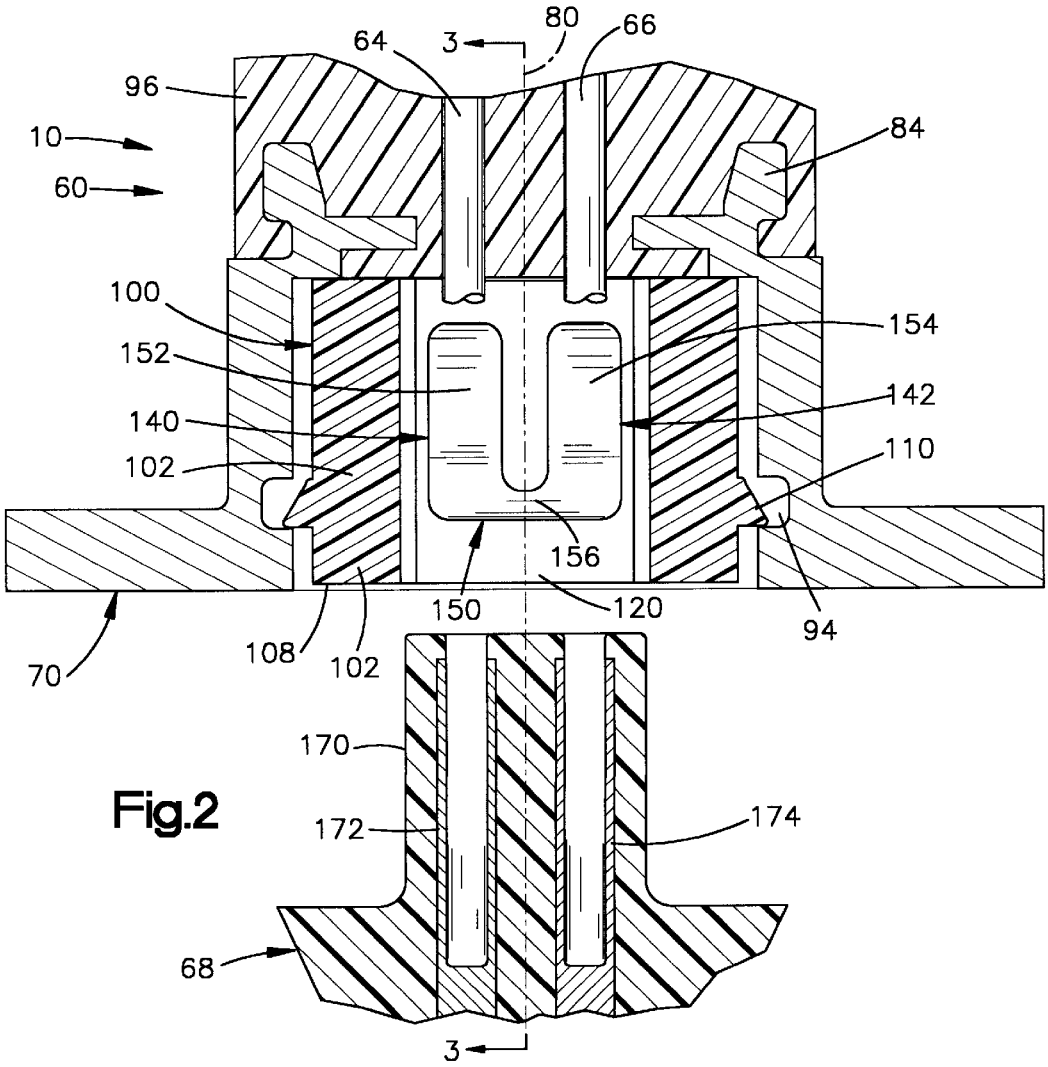
FIG. 2 is an enlarged view of a portion of the initiator assembly of FIG. 1 and also showing a portion of an electrical connector in a condition prior to engagement with the initiator assembly.

The inflator 10 (FIG. 2) includes a housing 20. The housing 20 is made of three pieces, namely, a diffuser cup 22, a combustion cup 24, and a combustion chamber cover 26. The diffuser cup 22 encloses the combustion cup 24 and has an annular array of gas outlet openings 28 formed in its upper portion. The combustion cup 24 has an annular array of openings 30 in its lower portion and is welded with continuous welds to the diffuser cup 22. The combustion chamber cover 26 is a generally flat metal piece having a circular central opening 34. The chamber cover 26 is welded with a continuous weld to the combustion cup 24 to close the combustion cup.

A hermetically sealed canister 40 is disposed in the combustion cup 24. A plurality of annular disks 42 of gas generating material are stacked atop each other within the canister 40. The disks 42 are made of a known material that, when ignited, generates nitrogen gas. Although many types of gas generating material could be used, suitable gas generating materials are disclosed in U.S. Pat. No. 3,895,098. An annular prefilter 44 is disposed in the canister 40, radially outward of the gas generating disks 42. A small recess in the center of the canister cover receives a packet 46 of auto ignition material.

An annular slag screen indicated schematically at 48 is located in the diffuser cup 22 radially outward of the openings 30 in the combustion cup 24. An annular final filter assembly indicated schematically at 50 is located above the slag screen 48. The final filter assembly 50 is radially inward of the gas outlet openings 28 in the diffuser cup 22.

The inflator 10 includes an initiator assembly 60. The initiator assembly 60 includes an igniter 62 which projects through the opening 34 in the chamber cover 26 into the canister 40. The igniter 62 may be of any suitable well known construction and includes a resistance wire (not shown) embedded in a known ignition material (not shown) in the igniter. The igniter 62 has a pair of externally projecting terminals in the form of cylindrical metal pins 64 and 66. The terminals 64 and 66 are connected to the resistance wire in the igniter 62.

Figure 4:
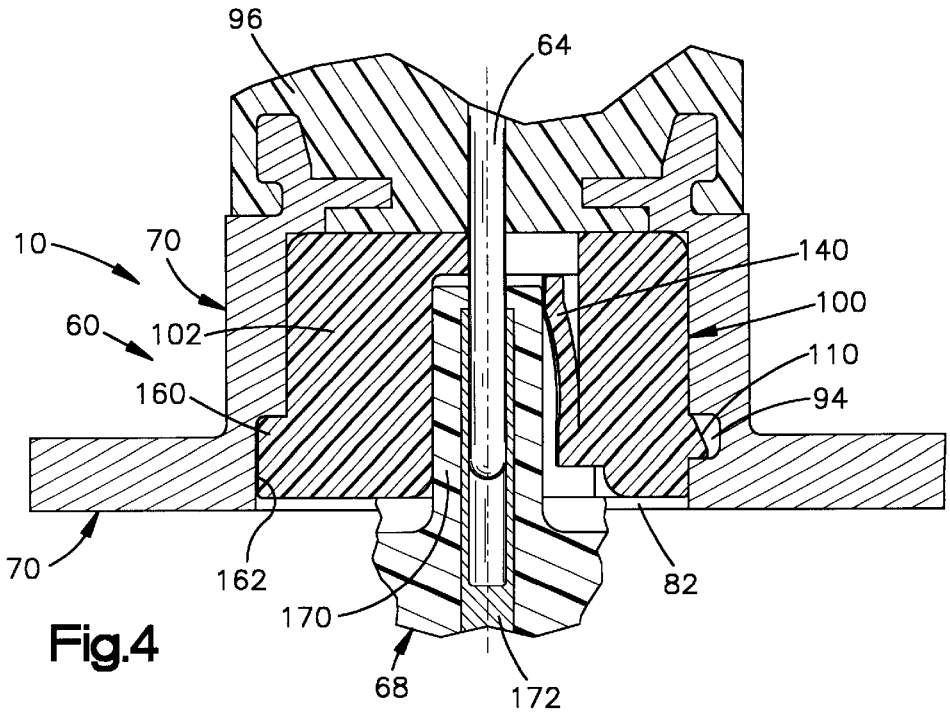
FIG. 4 is a view similar to FIG. 3 showing the shorting clip and the electrical connector in position on the initiator assembly.

When the inflator 10 is mounted in the vehicle, the terminals 64 and 66 are electrically connected with an electrical connector 68 (FIGS. 2 and 4) in a manner described below. The electrical connector 68 is connected to vehicle electric circuitry (not shown), including a vehicle condition sensor, for receiving an electrical signal to actuate the igniter 62. The electrical connector 68 is a commercially available part and is typically supplied by the manufacturer of the vehicle in which the inflator 10 is mounted, rather than by the manufacturer of the inflator.

Figure 3:
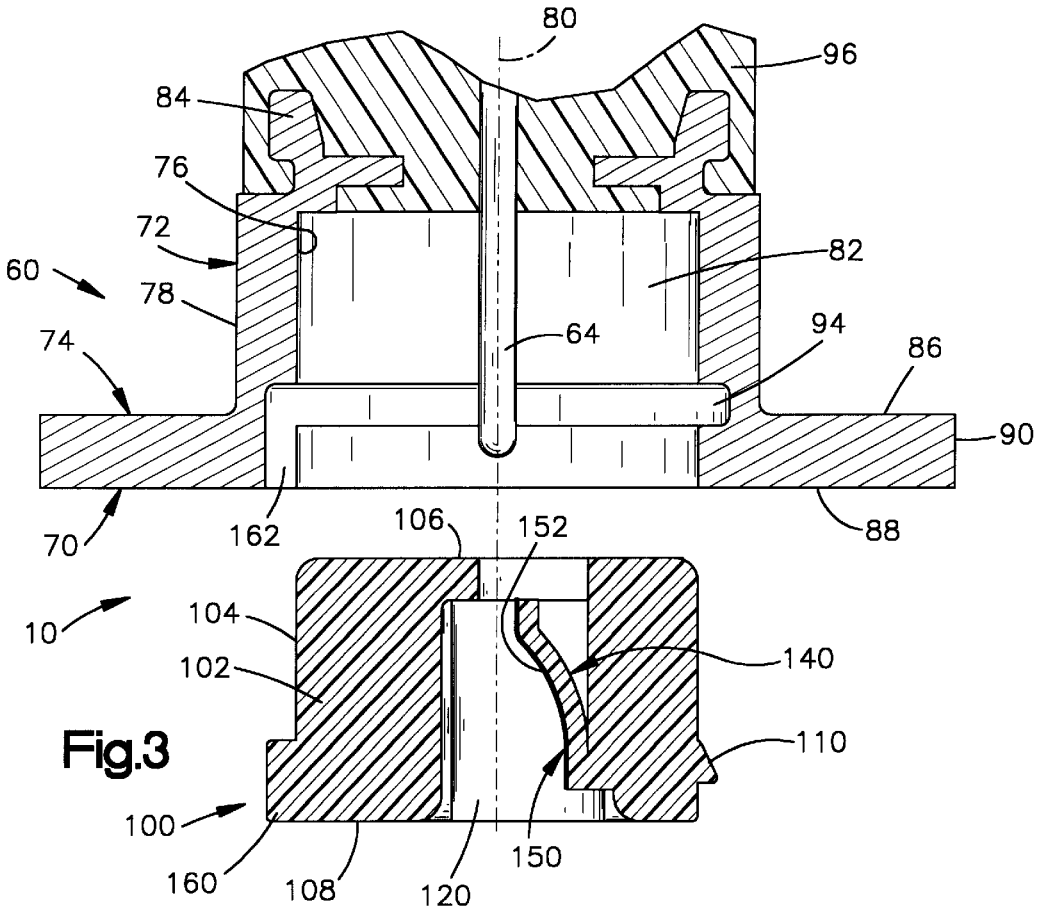
FIG. 3 is a sectional view of a portion of the initiator assembly and the shorting clip in a condition prior to assembly into the initiator assembly.

In addition to the igniter 62, the initiator assembly 60 includes a retainer 70 (FIGS. 2–4) for securing the igniter to the housing 20 of the inflator 10. The retainer 70 is preferably made of a weldable metal suitable for cold heading, such as UNS S30430 stainless steel.

The retainer 70 includes a tubular, axially extending socket portion 72 and an annular, radially extending flange portion 74 at one end of the socket portion. The socket portion 72 has cylindrical outer and inner circumferential surfaces 78 and 76 centered on an axis 80 of the inflator 10. The socket portion 72 and the flange portion 74 extend circumferentially around a central opening 82 of the retainer 72. An interlock portion 84 of the retainer 70 extends axially inward (upward as viewed in FIG. 4) from the socket portion 72.

The flange portion 74 of the retainer 70 has parallel, radially extending inner and outer side surfaces 86 and 88. An annular outer edge surface 90 extends axially between the inner and outer side surfaces 86 and 88. A circumferential recess or groove 94 is formed in the inner circumferential surface 76 of the retainer 70, near the outer side surface 88 of the flange portion 74 of the retainer.

A body of plastic material 96 encases and is in intimate contact with the interlock portion 84 of the retainer 70 and with the igniter 62. The terminals 64 and 66 of the igniter 62 extend axially from the body of plastic material 96 into the central opening 82 of the retainer 70. The body of plastic material 96 attaches the retainer 70 to the igniter 62. In the preferred embodiment, the body of plastic material 96 is injection molded nylon with a glass fill. Other materials which can be injection molded at low pressures and temperatures and which will adhere to the retainer 70 and to the igniter 62 are also suitable for use. Alternatively, the body of plastic material 96 could be an epoxy adhesive, or another material which is not injection molded.

After the igniter 62 is secured to the retainer 70 by the body of plastic material, the retainer is attached to the combustion chamber cover 26 (FIG. 2), preferably by welding along the outer edge surface 90. The cover 26 is then welded to the combustion cup 24. The igniter 62 is thereby secured in position in the inflator 10. It should be noted that the retainer 70 can be secured to the cover 26 by other means. For example, it is contemplated that the retainer 70 and the cover 26 may have complementary threaded portions which permit the retainer and the cover to be screwed together.

The initiator assembly 60 includes a shorting clip 100 which prevents accidental actuation of the igniter 62 prior to engagement of the electrical connector 62 with the initiator assembly. The shorting clip 100 also maintains the electrical connector 68 in electrical contact with the electrical terminals 64 and 66 of the igniter 62 after engagement of the electrical connector with the initiator assembly 60.

The shorting clip 100 is made from a single piece of injection molded plastic material 102 having a generally cylindrical configuration. A cylindrical outer side surface 104 of the shorting clip 100 extends parallel to the axis 80. The shorting clip 100 has parallel, radially extending inner and outer end surfaces 106 and 108. A plurality of beveled locking tabs 110 are formed on the outer side surface 104 of the shorting clip 100, near the outer end surface 108.

Figure 5:
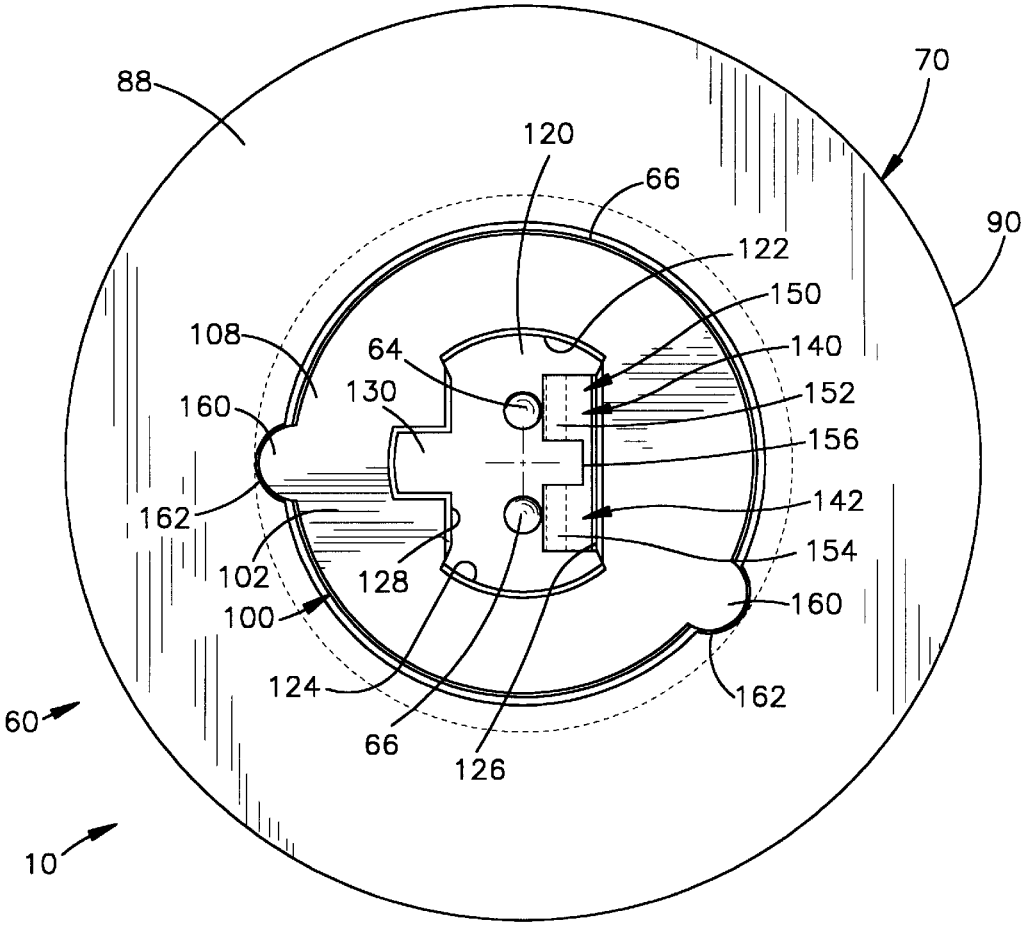
FIG. 5 is a bottom plan view of the initiator assembly and shorting clip.

The shorting clip 100 has a central opening 120 with a configuration adapted to receive the electrical connector 68. The central opening 120 of the shorting clip 100 is defined generally by a pair of arcuate, axially extending end surfaces 122 and 124 (FIG. 5) centered on and bowed outwardly from the axis 80, and a pair of planar side surfaces 126 and 128 which extend parallel to the axis. A portion 130 of the central opening 120 projects radially outward from the planar side surface 128 to provide asymmetry to the central opening for orientation purposes. The shorting clip 100 also has a pair of connector locking recesses (not shown) extending outward from the central opening 120.

The body of plastic material includes a pair of terminal contact portions in the form of shorting arms 140 and 142. The shorting arms 140 and 142 project from the side surface 126 of the shorting clip 100 into the central opening 120. The shorting arms 140 and 142 are made as one piece with the other plastic portions of the shorting clip 100. The shorting arms 140 and 142 are resiliently movable relative to the remainder of the main body portion 102.

The shorting clip 100 includes an electrically conductive plating 150, such as copper or gold, on the body of electrically insulating material 102. The electrically conductive plating 150 has a generally U-shaped configuration on the body of insulating material 102, matching the configuration of the two shorting arms 140 and 142, when viewed in elevation as in FIG. 3. A first portion 152 of the plating 150 is located on the first shorting arm 140. A second portion 154 of the plating 150 is located on the second shorting arm 142. A third or bridge portion 156 of the plating 150 extends between and electrically interconnects the first and second portions 152 and 154 of the plating.

The shorting clip 100 is inserted in the central opening 82 in the retainer 70, shortly after the retainer is molded to the igniter 62. The external configuration of the shorting clip 100 is adapted to fit closely within the internal configuration of the retainer 70, that is, within the surfaces which define the central opening 82 in the retainer. When the shorting clip 100 is engaged with the retainer 82, the outer side surface 104 on the shorting clip adjoins the cylindrical inner surface 76 on the retainer 70. The locking tabs 110 on the shorting clip 100 engage in the groove 94 in the retainer 70. A pair of locator tabs 160 on the shorting clip 100 engage in recesses 162 in the retainer 70 to assure proper rotational orientation of the shorting clip relative to the retainer.

When the shorting clip 100 is disposed in the central opening 82 in the retainer 70, the electrical terminals 64 and 66 of the igniter 62 extend into the central opening 120 of the shorting clip. The first metal plating portion 152 on the first shorting arm 140 of the shorting clip 100 engages the first electrical terminal 64 of the igniter 62. The second metal plating portion 154 on the second shorting arm 142 of the shorting clip 100 engages the second electrical terminal 66 of the igniter 62.

As a result, the electrically conductive plating 150 on the shorting clip 100 connects the terminals 64 and 66 of the igniter 62 electrically. This connection establishes a short circuit between the electrical terminals 64 and 66 of the igniter 62, when the electrical connector 68 is not in electrical contact with the terminals. The short circuit established by the shorting clip 100 does not extend through the bridgewire of the igniter 62. Therefore, any stray electrical current which might be applied across the electrical terminals 64 and 66 of the igniter 62 does not result in actuation of the ignition material in the igniter, and thus does not cause actuation of the inflator 10.

When the inflator 10 is thereafter mounted in the vehicle, the inflator is electrically connected to the vehicle electric circuitry by the electrical connector 68. The electrical connector 68 has a projecting portion 170, made of an electrically insulating material such as plastic. Two split cylindrical metal sleeves 172 and 174 are molded into the projecting portion 170 of the electrical connector 68. The metal sleeves 172 and 174 connect to lead wires (not shown) which extend away from the electrical connector 68 and which are connectable to the vehicle electric circuitry for receiving an actuating signal for the igniter 62.

The projecting portion 170 of the electrical connector 68 fits into the central opening 120 in the shorting clip 100. The metal terminals 64 and 66 of the igniter 62 are received in the metal sleeves 172 and 174 of the electrical connector 68 to establish electrical contact between the igniter 62 and the vehicle electric circuitry. At the same time, the projecting portion 170 of the electrical connector 68 bends the shorting arms 140 and 142 of the shorting clip 100 away from the axis 80 to disconnect the short circuit established by the shorting clip. A pair of locking arms (not shown) on the electrical connector engage in the connector locking recesses in the shorting clip 100 to maintain the electrical connector 68 in electrical contact with the electrical terminals 64 and 66 of the igniter 62.

Upon sensing of a vehicle condition for which inflation of the air bag 12 is desired for protection of a vehicle occupant, an electrical actuating signal is transmitted through the electrical connector 68 and through the terminals 64 and 66 to the igniter 62. The igniter 62 is actuated and provides hot combustion products which flow outwardly from the igniter 62 and rupture an inner wall of the canister 40. The hot combustion products from the igniter 62 ignite the disks 42 of gas generating material. The disks 42 of gas generating material rapidly produce a large volume of inflation fluid.

The pressure of the inflation fluid ruptures the outer side wall of the canister 40. The inflation fluid then flows radially outwardly through the prefilter 44, through the openings 30 and into the slag screen 48. The inflation fluid flows axially upward from the slag screen 48 to the final filter assembly 50. The gas then flows radially outwardly through the final filter assembly 50 and the gas outlet openings 28 into the air bag 12.

From the above description of the invention, those skilled in the art will perceive improvements, changes and modifications in the invention. Such improvements, changes and modifications within the skill of the art are intended to be covered by the appended claims.

Having described the invention, I claim:

1. A shorting clip for establishing a short circuit between first and second electrical terminals of an air bag inflator initiator, said shorting clip comprising:

a body of electrically insulating material having first and second contact portions engageable with the first and second electrical terminals of the initiator when said shorting clip is connected to the initiator; and electrically conductive plating on said body of electrically insulating material, said electrically conductive plating having a generally U-shaped configuration and including a first portion, a second portion, and a bridge portion for establishing electrical contact between the first and second electrical terminals of the initiator;

said first portion of said electrically conductive plating being formed on said first contact portion of said body of electrically insulating material for engaging the first electrical terminal of the initiator, said second portion of said electrically conductive plating being formed on said second contact portion of said body of electrically insulating material for engaging the second electrical terminal of the initiator, and said bridge portion of said electrically conductive plating extending between and electrically interconnecting said first and second portions of said electrically conductive plating for electrically connecting the first and second electrical terminals of the initiator.

2. A shorting clip as set forth in claim 1 wherein said contact portions of said body of electrically insulating material are resilient arms.

3. A shorting clip as set forth in claim 1 having a central opening for receiving an electrical connector, the electrical connector having portions electrically connectable with the first and second electrical terminals of the initiator, the electrical connector having a portion for moving said contact portions of said body of insulating material out of engagement with the first and second electrical terminals of the initiator upon movement of the electrical connector into said central opening of said shorting clip.

4. A shorting clip as set forth in claim 3 wherein said contact portions of said body of electrically insulating material project into said central opening of said shorting clip.

5. A shorting clip as set forth in claim 4 wherein said contact portions of said body of electrically insulating material are resilient.

6. A shorting clip as set forth in claim 4 wherein said bridge portion of said electrically conductive plating forms a portion of a surface within said central opening of said shorting clip.

7. A shorting clip for establishing a short circuit between first and second electrical terminals of an air bag inflator initiator and for supporting an electrical connector which supplies an electric actuating signal to the initiator, said shorting clip comprising:

a one-piece molded body of electrically insulating material having an outer portion engageable with the initiator for connecting said shorting clip to the initiator and having an inner portion for receiving and supporting the electrical connector;

electrically conductive plating being formed on said inner portion of said body of electrically insulating material, said electrically conductive plating having a first portion, a second portion, and a bridge portion, said first portion being engageable with the first electrical terminal of the initiator, said second portion being engageable with the second electrical terminal of the initiator, and said bridge portion electrically interconnecting said first and second portions for electrically connecting the first and second electrical terminals of the initiator when said shorting clip is connected to the initiator.

8. A shorting clip as set forth in claim 7, having a central opening for receiving an electrical connector which is electrically connectable with the first and second electrical terminals of the initiator, said shorting clip having arm portions which are movable by the electrical connector out of engagement with the first and second electrical terminals of the initiator upon movement of the electrical connector into said central opening of said shorting clip.

* * * * *